United States Patent [19]

Ross, Jr. et al.

[11] Patent Number: 4,949,965

[45] Date of Patent: Aug. 21, 1990

[54] POOL STICK SHAFT CONSTRUCTION

[76] Inventors: Marion J. Ross, Jr., 2629 E. Serendipity Cir., Colorado Springs, Colo. 80917; David M. Kikel, 3650 N. Academy Blvd., #8, both of Colorado Springs, Colo.

[21] Appl. No.: 329,613

[22] Filed: Mar. 28, 1989

[51] Int. Cl.[5] ..... A64D 13/00

[52] U.S. Cl. ..... 273/68; 273/70

[58] Field of Search ..... 273/68, 70

[56] References Cited

U.S. PATENT DOCUMENTS

| | | | |
|---|---|---|---|
| 672,646 | 4/1901 | Mereness, Jr. | 273/68 |
| 941,728 | 11/1909 | Preast | 273/68 |
| 1,111,497 | 9/1914 | Robinette | 273/70 |
| 1,153,491 | 9/1915 | Haynes | 273/70 |

FOREIGN PATENT DOCUMENTS

| | | | |
|---|---|---|---|
| 585446 | 11/1958 | Italy | 273/68 |
| 1809 | 1/1905 | United Kingdom | 273/68 |
| 180514 | 6/1922 | United Kingdom | 273/68 |
| 1565725 | 4/1980 | United Kingdom | 273/68 |

*Primary Examiner*—Edward M. Coven
*Assistant Examiner*—Mark S. Graham
*Attorney, Agent, or Firm*—Henderson & Sturm

[57] ABSTRACT

A cue stick construction (10) including an intermediate relatively narrow insert segment (13) fabricated from a first wood having a contrasting color to a second wood from which two enlarged laminate segments (12) are fabricated wherein the narrow insert segment forms diagonally opposed elongated sighting reference lines on the external periphery of the cue stick shaft construction (10) and a ferrule tip unit (20) equipped with opposed inserts (23) that may be aligned with the insert segment (13).

3 Claims, 1 Drawing Sheet

POOL STICK SHAFT CONSTRUCTION

TECHNICAL FIELD

The present invention relates generally to the field of pool stick shaft constructions, and more particularly to laminated shaft constructions.

BACKGROUND OF THE INVENTION

As can be seen by reference to the following U.S. Pat. No's. 941,728 and 672,646 the prior art is replete with myriad and diverse laminated pool stick constructions.

While both of the aforementioned prior art pool stick constructions are more than adequate for fulfilling the basic purpose and function for which they have been specifically designed, neither of these patented devices are particularly useful for assisting a player in lining up a shot.

As most pool and billiard players are all too well aware, one of the most critical aspects of these sports is the proper alignment with the cue shaft and the surface of the cue ball to propel the cue ball in the proper trajectory towards the target ball or the sides of the table in accomplishing a desired shot.

Given the widespread popularity of pool and billiards it comes as somewhat of a surprise that to date no one has apparently developed a cue stick shaft construction that will incorporate an aiming reference line into the shaft material per se; such that the player may utilize the integrally formed reference line to align their shots and improve their game.

Obviously there has existed a longstanding need for such a construction and the provision of exactly this type of an arrangement is a stated objective of the invention.

SUMMARY OF THE INVENTION

Briefly stated, the pool cue shaft construction that forms the basis of the present invention comprises the use of contrasting color wood laminate to produce a cue shaft that has a straight thin strip of wood which bisects the cue shaft and extends along the axial length of the cue shaft to form a reference line on opposite sides of the cue shaft.

In essence the cue shaft construction of this invention comprises two crescent shaped tapered laminates disposed on opposite sides of a narrow tapered insert having a rounded upper and lower surface which forms a continuation of the circular peripheries of the crescent shaped laminates along the length of the cue shaft; wherein, the intermediate insert is chosen from wood having a contrasting color to the color of the wood that is chosen for the fabrication of the crescent shaped tapered laminates.

Given the difference in color and dimensions of the insert relative to the crescent shaped laminates the insert will create a thin reference sighting line on opposite sides of the finished cue shaft.

BRIEF DESCRIPTION OF THE DRAWINGS

These and other objects, advantages, and novel features of the invention will become apparent from the detailed description of the best mode for carrying out the preferred embodiment of the invention which follows; particularly when considered in conjunction with the accompanying drawings, wherein.

BEST MODE FOR CARRYING OUT THE INVENTION

Figure 3:
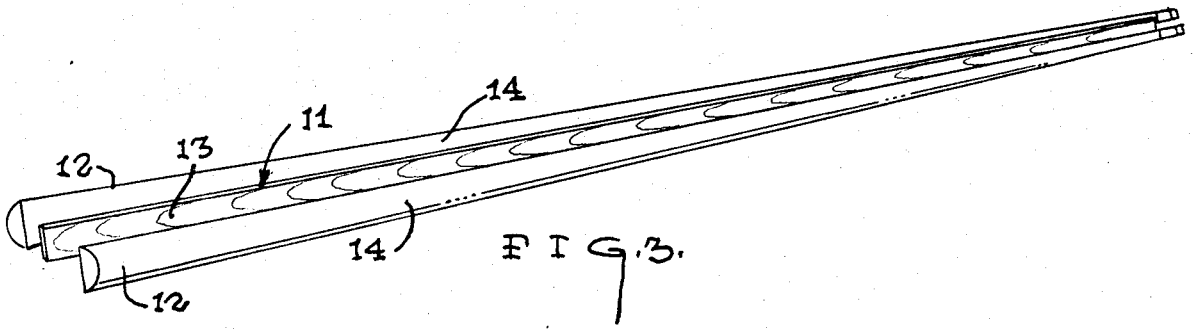
FIG. 3 is an exploded perspective view.

As can be seen by reference to the drawings and in particular to FIG. 3, the cue stick construction that forms the basis of the present invention is designated generally by the reference numeral (10). The stick construction (10) comprises in general: an intermediate relatively narrow insert segment (11) disposed between two enlarged laminate segments (12) which comprise the cue shaft (50) and a ferrule tip unit (20). These segments will now be described in seriatim fashion.

Figure 1:
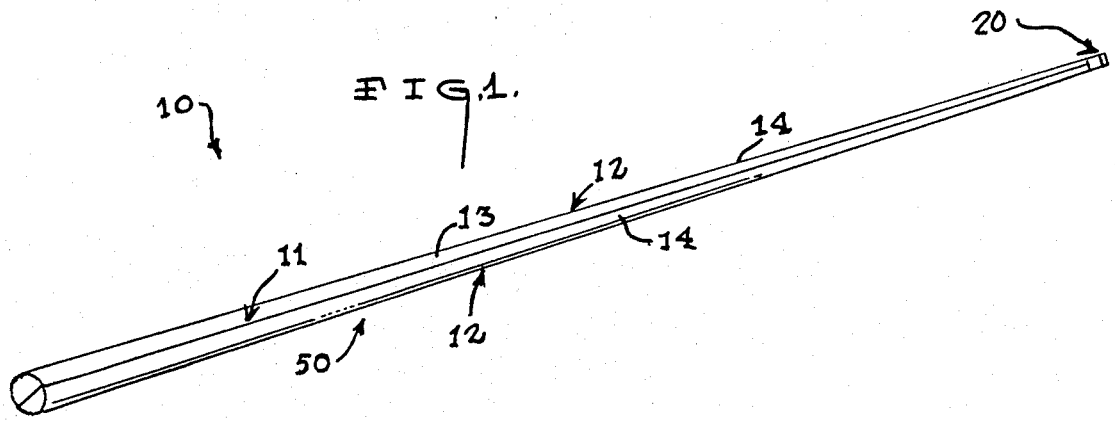
FIG. 1 is a perspective view of the finished cue stick.
Figure 2:
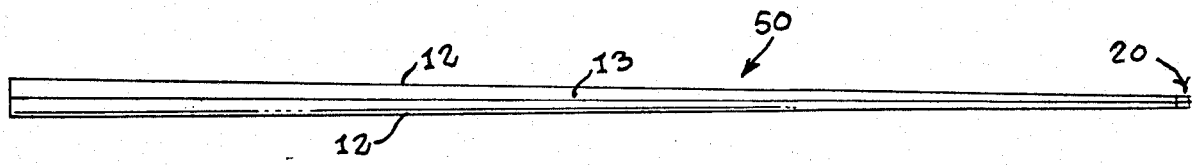
FIG. 2 is a top plan view.

Turning now to FIGS. 1 and 2, it can be appreciated that the finished cue stick construction (10) has a well recognized elongated smooth tapered cylindrical configuration. Keeping the finished configuration in mind, it can be appreciated that the intermediate insert segment (11) has an elongated tapered trapezoidal configuration wherein both the upper and lower surfaces of the insert segment (11) are rounded in conformity with the finished configuration. In addition, as depicted in FIG. 3 the insert segment (11) is fabricated from a thin strip of wood (13) having a first selected coloration and/or grain configuration.

Figure 4:
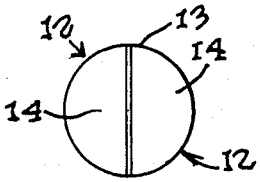
FIG. 4 is an end plan view.
Figure 5:
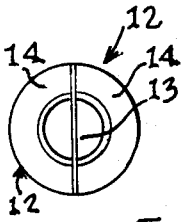
FIG. 5 is a front plan view.

As can best be appreciated by reference to FIGS. 3 thru 5, the enlarged laminate segments (12) comprise a pair of mirror image generally crescent shaped tapered strips of wood (14) having a second selected coloration and/or grain configuration.

As can also be appreciated by reference to FIGS. 3 through 5, the intermediate insert segment (11) is sandwiched between the laminated to the vertical faces of the enlarged laminate segments (12) in a well recognized manner, and the rounded upper and lower curved surfaces of the intermediate insert segment have the same radial arc relative to the longitudinal axis of the finished shaft construction (10).

By choosing contrasting colored wood for the intermediate insert (11) segment and the enlarged laminate segments (12) the intermediate insert segment will diagonally bisect the finished cue shaft (10) forming axially aligned reference sighting lines (15) on opposite sides of the finished cue shaft.

In one example of contrasting colored woods to be employed in this invention the first selected wood would be walnut and the second selected wood would be maple. However, it should also be appreciated that these choices can be reversed and/or other contrasting colored woods substituted in their place.

Figure 6:
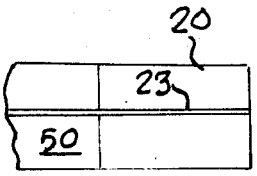
FIG. 6 is an enlarged detail view of the end of the shaft and the ferrule tip; and, FIG. 7 is an enlarged exploded perspective view of the ferrule tip.
Figure 7:
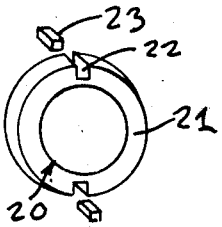

Turning now to FIGS. 6 and 7, it can be seen that the ferrule tip unit (20) comprises a generally hollow cylindrical ferrule member (21) dimensioned to receive the tapered end of the cue shaft (50). In addition, the ferrule member (21) is further provided with a pair of elongated diametrically opposed relatively narrow recesses (22) that are adapted to receive relatively thin inserts (23) that are fabricated in a contrasting color to the color of the ferrule member (21); such that, the inserts can be aligned with the intermediate insert segment (13) of the shaft unit (50) to produce a sighting and aiming reference line that extends along the entire length of the finished stick construction (10).

Having thereby described the subject matter of this invention it should be apparent that many substitutions, modification, and variations of the invention are possible in light of the above teachings. It is therefore to be understood that the invention as taught and described herein is only to be limited to the extent of the breadth and scope of the appended claims.

We claim:

1. A cue stick construction comprising:

a shaft unit with a tapered end which includes a pair of mirror image generally enlarged laminate segments with an outer periphery fabricated from wood having a first selected color; and, a relatively narrow intermediate insert segment sandwiched between said laminate segments wherein said insert segment has upper and lower surfaces and is fabricated from wood having a second selected color which contrasts with said first selected color; and, a ferrule tip unit including a generally hollow cylindrical ferrule member dimensioned to receive the tapered end of said shaft unit; wherein, the ferrule member is provided with a pair of elongated diametrically opposed narrow recesses that are dimensioned to receive relatively thin inserts wherein said inserts are aligned with said intermediate insert segment of said shaft unit.

2. The cue stick construction as in claim 1 having a generally tapered cylindrical configuration.

3. The cue stick construction as in claim 1 wherein both the outer periphery of the laminate segments and the upper and lower surfaces of the intermediate segment are provided with an arcuate configuration formed by the same radial arc generated relative to the longitudinal axis of the shaft unit.

* * * * *